US007223186B2

(12) United States Patent
Tresvant

(10) Patent No.: US 7,223,186 B2
(45) Date of Patent: May 29, 2007

(54) APPARATUS, ASSEMBLIES AND METHODS FOR TRAINING ATHLETES

(76) Inventor: John B. Tresvant, 14814 61st Dr. SE., Snohomish, WA (US) 98296

( * ) Notice: Subject to any disclaimer, the term of this patent is extended or adjusted under 35 U.S.C. 154(b) by 0 days.

(21) Appl. No.: 11/130,888

(22) Filed: May 17, 2005

(65) Prior Publication Data

US 2006/0035732 A1 Feb. 16, 2006

Related U.S. Application Data

(60) Provisional application No. 60/600,535, filed on Aug. 11, 2004.

(51) Int. Cl.
*A63B 69/00* (2006.01)
*A63B 63/08* (2006.01)

(52) U.S. Cl. ..... 473/447; 473/423; 473/433; 473/485

(58) Field of Classification Search ..... 473/422, 473/433–436, 447–449, 479–489; 273/317.3
See application file for complete search history.

(56) References Cited

U.S. PATENT DOCUMENTS 2,948,432 A * 8/1960 Jepsen ..... 473/575
3,012,781 A * 12/1961 Nelson ..... 473/430
3,717,342 A * 2/1973 Haney et al. ..... 473/430
4,023,797 A * 5/1977 Sarrasin ..... 473/425
4,161,313 A * 7/1979 Dickey ..... 473/449
4,296,925 A * 10/1981 Alston ..... 473/430
4,462,599 A * 7/1984 Brown ..... 473/430
4,534,556 A * 8/1985 Estlund et al. ..... 473/486
4,621,811 A * 11/1986 Campbell ..... 473/430
4,687,209 A * 8/1987 Carey ..... 473/424
4,948,150 A * 8/1990 Daly et al. ..... 473/430
5,209,713 A * 5/1993 Brown et al. ..... 482/92
5,308,059 A * 5/1994 Owen et al. ..... 473/448
5,417,631 A * 5/1995 Brown et al. ..... 482/92
5,584,481 A * 12/1996 Caluori et al. ..... 473/446
5,586,760 A * 12/1996 Hauter ..... 473/424
5,827,136 A * 10/1998 Halter et al. ..... 473/447
5,916,046 A * 6/1999 Allred et al. ..... 473/430
6,050,305 A * 4/2000 Braun et al. ..... 139/455
6,267,696 B1 * 7/2001 Mabe et al. ..... 473/433
6,348,028 B1 * 2/2002 Cragg ..... 482/148

* cited by examiner

*Primary Examiner*—Mitra Aryanpour
(74) *Attorney, Agent, or Firm*—DWC Law Firm, P.S.

(57) ABSTRACT

An athletic training assembly and methods suitable for use in training basketball players. The training assembly allows a ball to be suspended at a selectable height by a suspension member that is attached to a spring loaded reel. The spring loaded reel urges the ball upward when a user grabs the ball to pull it away from the spring loaded reel.

23 Claims, 17 Drawing Sheets

APPARATUS, ASSEMBLIES AND METHODS FOR TRAINING ATHLETES

CROSS-REFERENCE TO RELATED APPLICATION(S)

This application claims the benefit of U.S. Provisional Patent Application No. 60/600,535 filed Aug. 11, 2004, which is incorporated herein by reference in its entirety.

BACKGROUND

1. Field of the Invention

The present invention relates generally to training apparatus for training athletes.

2. Description of Related Art

Various athletic skills are required to play the sport of basketball, especially at advanced levels, including running, dribbling, passing, rebounding, catching and shooting. Athletes and coaches often use practice drills to improve these skills and experience has shown that drills can be invaluable for improving player performance during actual game play.

Rebounding drills are among the important categories of practice drills. One type of conventional rebound drill involves players repeatedly catching, grabbing or tipping basketballs in midair that have been thrown or bounced from a basketball backboard. This type of rebound drill has some benefits. On the other hand, it does not offer control over the height at which the rebounding player makes contact with the ball. Players that are deficient in vertical leap and timing in game play rebounds may continue to perform the same way during conventional rebounding drills. A more controlled method of rebound training is desirable and could be combined with conventional rebound drills.

BRIEF SUMMARY OF THE INVENTION

The present invention generally resides in athletic training apparatus and assemblies and methods for using the same. In some embodiments of the present invention, a training assembly is disclosed having a mounting bracket that is attachable to a basketball backboard or other surface. A reel housing containing a spring loaded reel is attached to the mounting bracket, with a suspension member, such as a rope or cable, attached to the spring loaded reel. The suspension member extends away from the spring loaded reel, and can hang down from the spring loaded reel. The spring loaded reel can be contained within the reel housing, such that the suspension member extends through an aperture in the reel housing. A distal end portion of the suspension member is coupled to a ball (e.g., a basketball) so that the ball can hang from the suspension member. The spring loaded reel can have sufficient spring force to be capable of retracting the suspension member against the weight of the ball, and hence pull the ball toward the spring loaded reel. However, a user or player can exert sufficient counteracting force against the spring force to pull the ball away from the spring loaded reel during training. Also, in some embodiments, a stop, such as a rubber stop, is coupled to the suspension member and prevents the spring loaded reel from pulling the ball flush against the reel housing by "stopping" the suspension member at a designated location along the suspension member. The stop can be a plug type stop that is disposed at a location along the suspension member to prevent the suspension member from being retracted through the reel housing past the point at which the stop is located. Therefore, the remaining portion of the suspension member (outward of the stop) can hang below the reel housing, and hence, hang the ball below the reel housing.

A basketball player may use the training assembly to practice such skills as rebounding. For example, in some embodiments the reel housing is disposed at a height above, or near, the top of a basketball backboard. A ball can hang from the reel housing via the suspension member at a height that can be adjusted to approximate various heights of a basketball during rebounding in game play. The height can also be adjusted to approximate a maximum height that a particular basketball player can jump (i.e., the player's "vertical") to help the player improve her or his "vertical" and rebounding skills—the height of the ball can be adjusted in some embodiments by adjusting the location of the stop along the length of the suspension member, or by adjusting the height of a backboard to which the training assembly is attached.

In another embodiment of the present invention, the reel housing is mounted on a height adjustment assembly that includes a pivotable arm that is linked to a threaded drive shaft. The threaded drive shaft can be used to drive the pivotable arm to adjust the height of the reel housing and ball.

A player may be required during practice to jump at the ball to tip or grab the ball. If a player reaches the ball, the player can tip it to give the ball motion and continue attempting to tip the ball. Alternatively, the player can attempt to grab and pull the ball downward with the player as she or he descends from a jump, thereby simulating grabbing a ball rebounded from a basketball hoop or a backboard. In some embodiments, tension is selectable in the spring loaded reel to adjust the pulling and grabbing force required of a player to grab the ball and pull it downward.

As previously stated, in some embodiments the spring loaded reel is enclosed in a reel housing. The reel housing can have a pivotable sidewall that can pivot outward away from the rest of the reel housing to expose an inside of the reel housing. Also, the spring loaded reel can be rotatably attached to a reel mount, which, in turn, is attached to an inside portion of the pivotable sidewall. Pivoting the pivotable sidewall outward away from the rest of the reel housing can expose the spring loaded reel, while pivoting the sidewall toward the rest of the reel housing can enclose the spring loaded reel within the reel housing. This can provide a manner with which to access the spring loaded reel for maintenance purposes, or for changing the spring loaded reel with a reel having different tension.

In another embodiment of the present invention, a basketball backboard is configured to be conveniently usable with the training assembly. In particular, a basketball hoop of the backboard is rotatable away from a front of the backboard to avoid interfering with use of a training assembly, since use of the training assembly can require the suspension member and ball to hang down in front of the backboard.

In further embodiments, the training assembly is pivotably mounted on a basketball backboard, for conveniently pivoting the training assembly away from a front of the backboard to allow the backboard to be used for game play without the training assembly potentially interfering. In still further embodiments, both the training assembly and basketball hoop can be pivotably mounted on the basketball backboard.

DETAILED DESCRIPTION OF PREFERRED EMBODIMENTS

In the following description, certain specific details are set forth in order to provide a thorough understanding of various embodiments of the invention. However, upon reviewing this disclosure one skilled in the art will understand that the invention may be practiced without many of these details. In other instances, well-known structures associated with spring-loaded reels, basketballs, basketball backboards and height adjustment assemblies for basketball backboards have not been described in detail to avoid unnecessarily obscuring the descriptions of the embodiments of the invention.

Throughout various portions of the following description, the embodiments of the present invention are described in the context of training apparatus and methods for training basketball players. However, as will be understood by one skilled in the art after reviewing this disclosure, various embodiments of the present invention have a wide variety of applications for other athletic training and the context of the description is not intended to be restrictive unless otherwise indicated.

The term "suspension member" as used herein, is intended to include, without limitation, tethers, ropes, cables, strings, chains, cords, bands and any elongated member or elongated flexible member suitable for attachment to a ball of any type for suspending the ball from a mounting bracket or other device or location, as will be appreciated by one skilled in the art after reviewing this disclosure.

Figure 1:
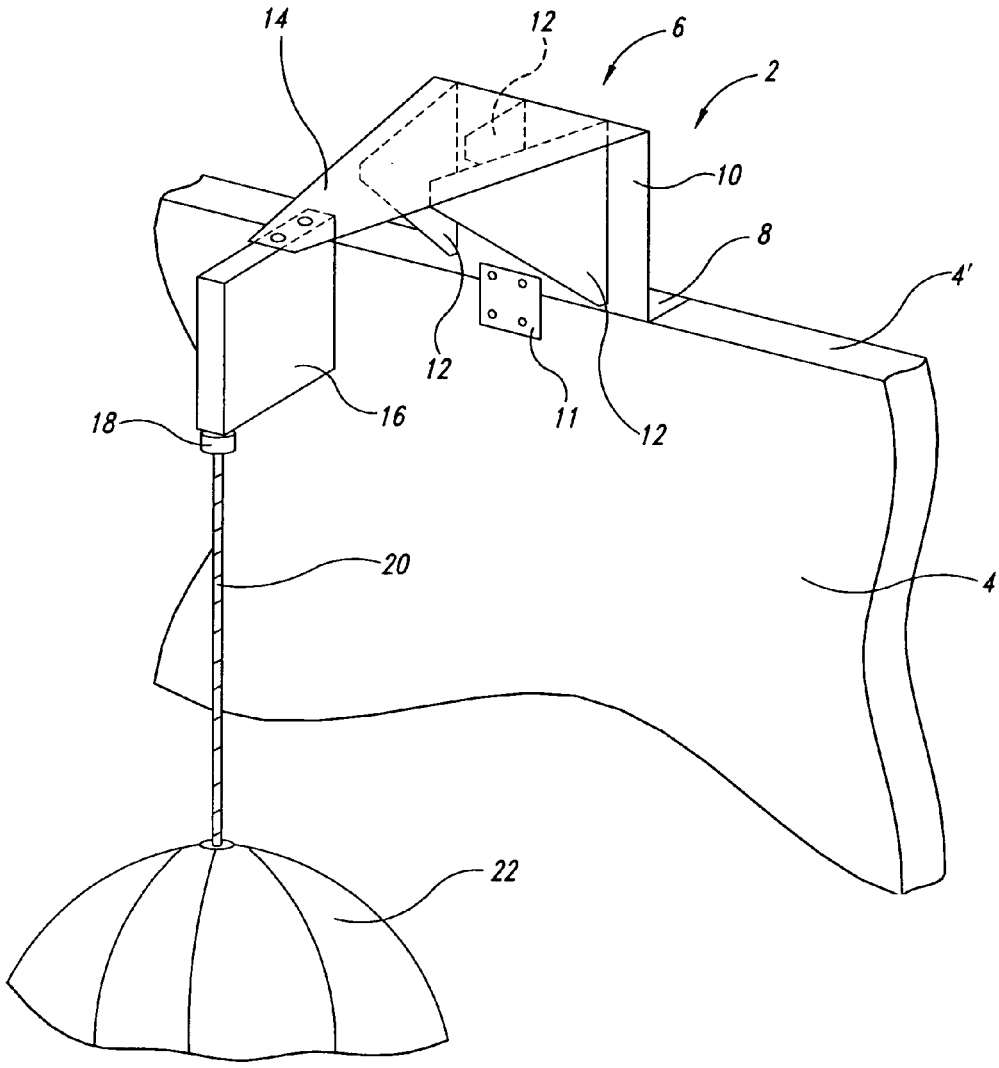
FIG. 1 is a partial perspective view of an embodiment of the present invention showing a training assembly of the present invention attached to a basketball backboard.

Some embodiments of the present invention relate to a training assembly 2 comprising a mounting bracket 6, a reel housing 16, a suspension member 20, a stop 18, and a ball 22, as can be seen in FIG. 1. In turn, the training assembly 2 can be attached to a backboard 4, such as a basketball backboard, or other mountable surface.

Figure 3:
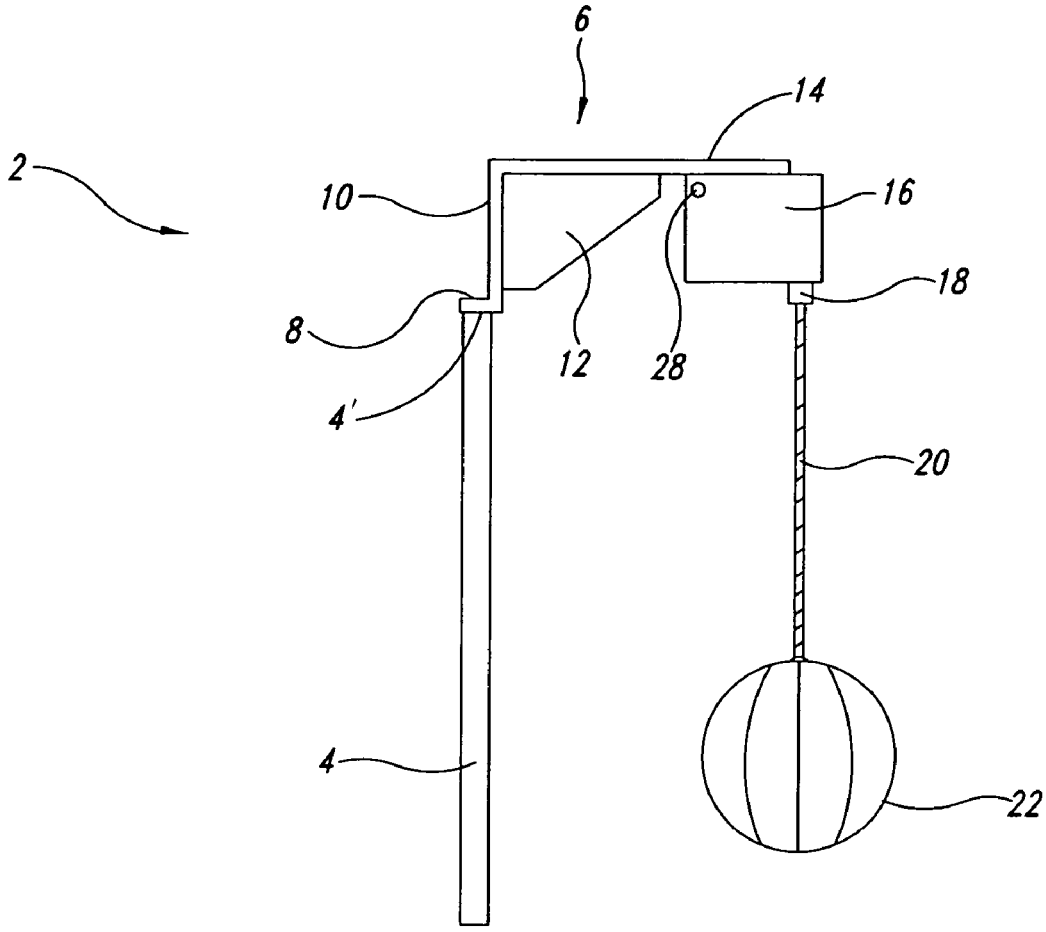
FIG. 3 is a side elevational view of the training assembly of FIG. 1, shown attached to a basketball backboard.

In the illustrated embodiment in FIGS. 1 & 3, the mounting bracket 6 has an attachment portion 8 that can be coupled to the backboard 4 as shown. The attachment portion 8 is illustrated as rectangular strip configured to rest and be coupled to a top edge portion 4' of the backboard 4. A rising section 10, such as a vertical wall portion, extends upwardly away from the attachment portion 8. The mounting bracket 6 further includes a retaining portion 14 that is attached to a top part of the rising section 10, with the retaining portion 14 extending laterally outward from the rising section 10. In some embodiments, the mounting bracket 6 also has support members 12 attached to both the rising section 10 and retaining portion 14, as best seen in FIG. 1. Also, a support piece 11 can be coupled to the rising section 10 and the backboard 4 to reinforce the strength with which the mounting bracket 6 is attached to the backboard 4.

Figure 4:
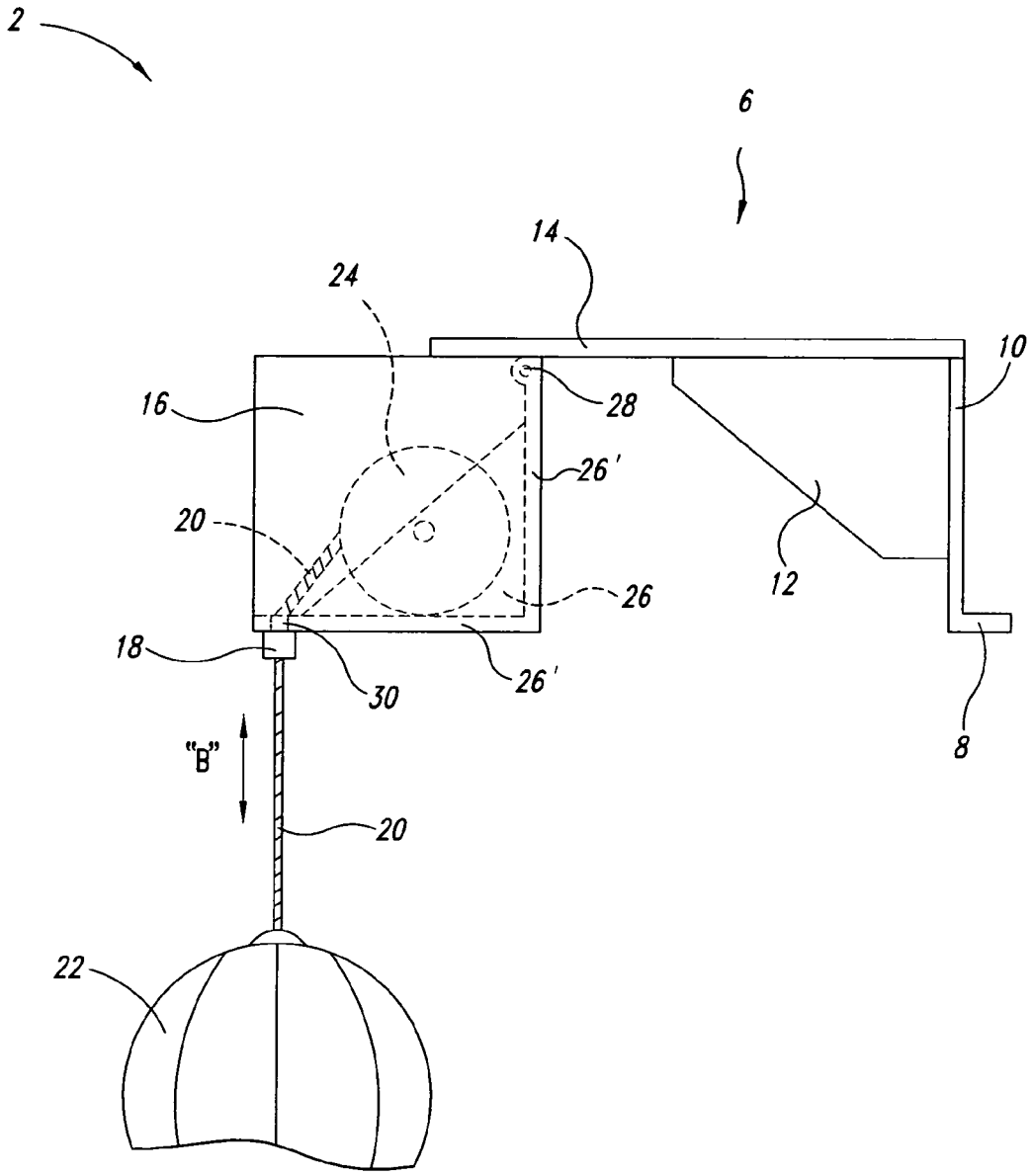
FIG. 4 is a partial side elevational view of the training assembly of FIG. 1 showing a reel housing having a spring-loaded reel disposed therein.
Figure 5:
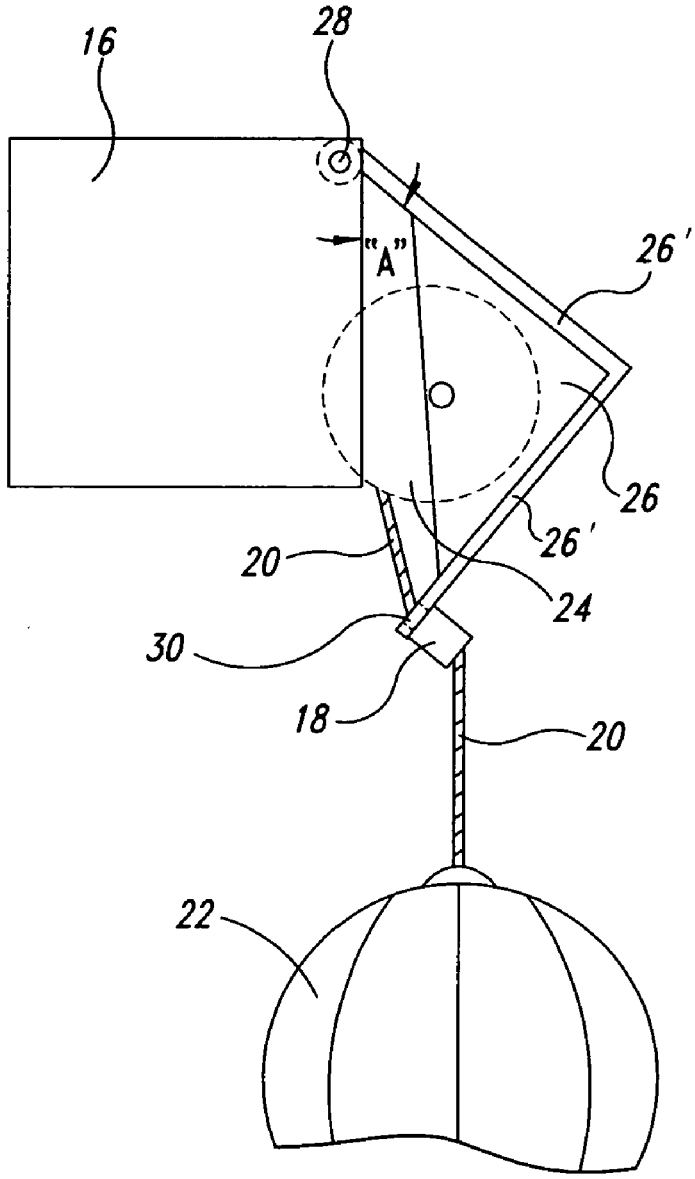
FIG. 5 is a partial side elevational view of the training assembly of FIG. 4 showing a pivotable sidewall of the reel housing having been pivoted outward exposing the spring loaded reel and a reel mount to which the spring loaded reel is rotatably attached.

Referring to FIGS. 4 & 5, it can be seen that in some embodiments of the present invention, the reel housing 16 is attached to the mounting bracket 6 by being coupled to the retaining portion 14. Also, a spring loaded reel 24 is rotatably attached to a reel mount 26 within the reel housing 16. The reel mount 26 is formed to a pivotable sidewall 26' of the reel housing 16. The pivotable sidewall 26' can be pivoted outward away from, or inwardly toward, the remainder of the reel housing 16 in a manner generally represented by the arrow "A" in FIG. 5. In this way, the spring loaded reel 24 and reel mount 26 can be exposed or enclosed within the reel housing 16 by pivoting the pivotable sidewall 26'. The pivotable sidewall 26' can also have a locking mechanism (not shown) for releasably locking the pivotable sidewall 26' in place when it is pivoted inward toward the rest of the reel housing 16 to its position illustrated in FIG. 4.

Figure 8C:
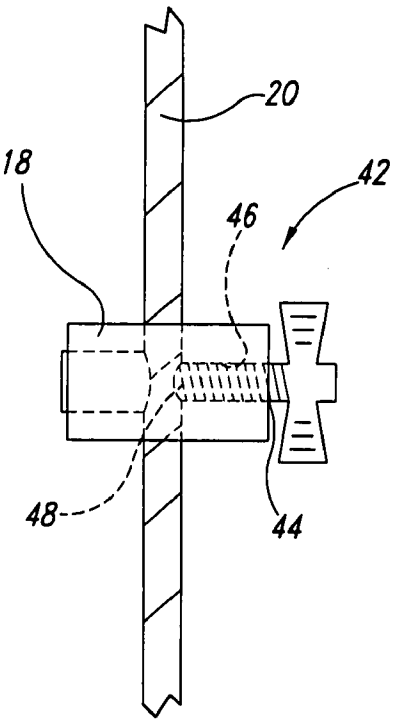
FIG. 8C is a front elevation view of an embodiment of an adjustable stop of the present invention for "stopping" retraction of the suspension member beyond a location of the stop.
Figure 8B:
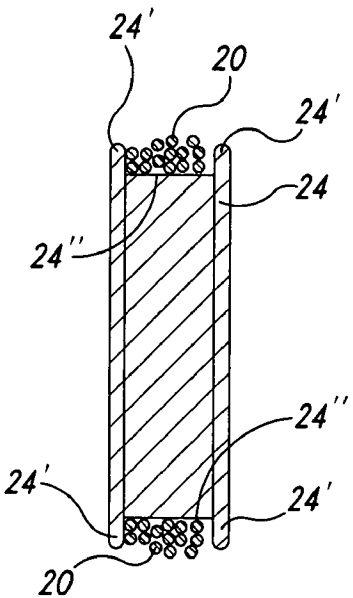
FIG. 8B is cross sectional view of the spring-loaded reel of FIG. 8A, as viewed from line 8B—8B.
Figure 8A:
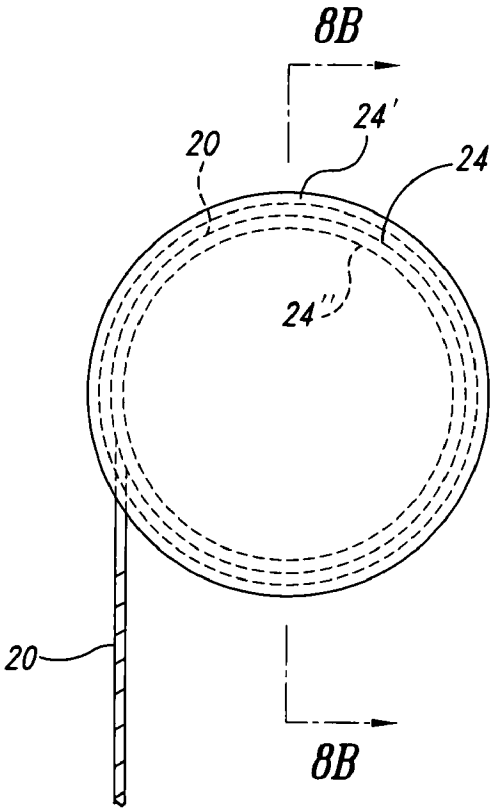
FIG. 8A is a side elevation view of a spring loaded reel of the present invention detached from the reel mount of FIG. 5.

As best seen in FIGS. 8*a* & 8*b*, the spring loaded reel 24 can have raised outer wall edges 24' that extend radially outward from an inner peripheral wall 24". The suspension member 20 can be coupled to the spring loaded reel 24 by being attached at an end portion thereof to the spring loaded reel 24 and wound for a portion of its length around a circumferential surface of the spring loaded reel. The circumferential surface shown in the embodiments of FIGS. 8*a* & 8*b*, is the inner peripheral wall 24".

Furthermore, as shown in FIGS. 4 & 5, a housing aperture 30 can be provided in the reel housing 16 through which the suspension member 20 can be passed and extended outward away from the reel housing 16. A ball 22 can be coupled to a distal end portion of the suspension member 20.

Figure 2:
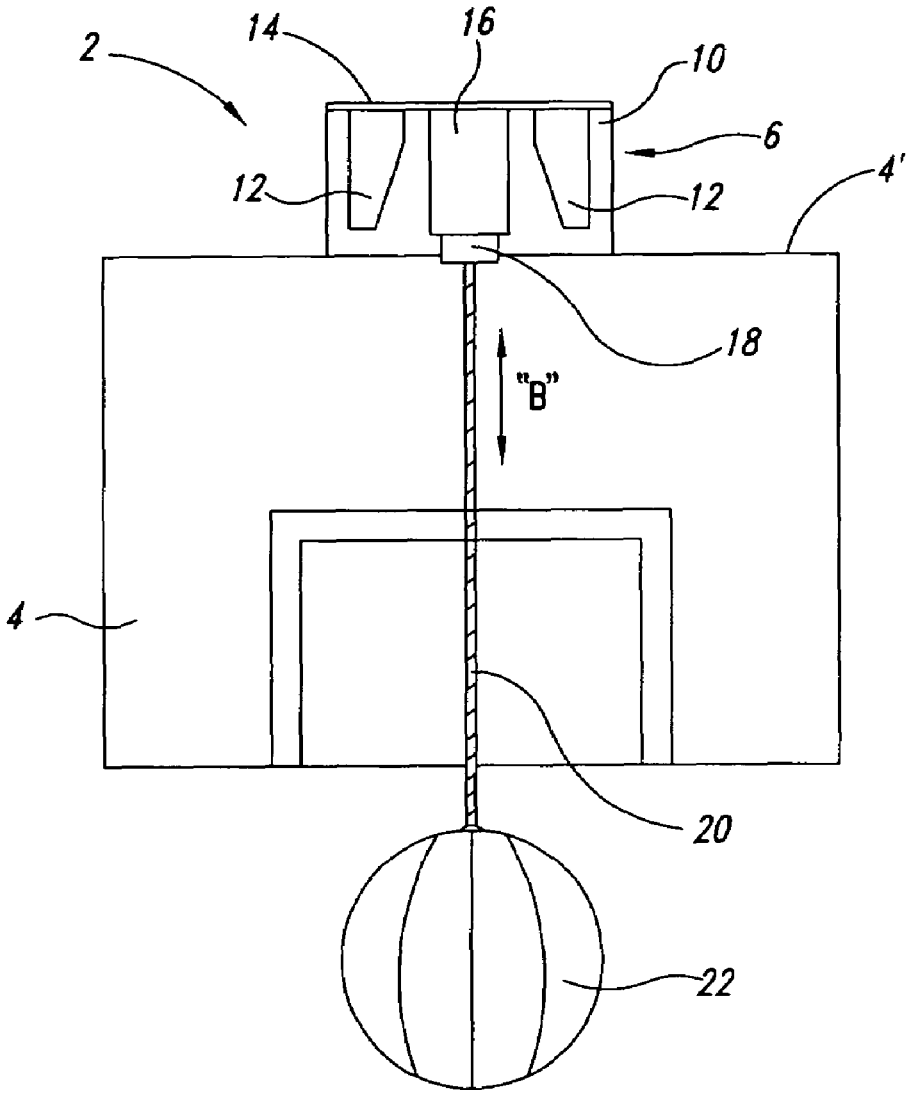
FIG. 2 is a front elevational view of the training assembly of FIG. 1, shown attached to a basketball backboard.

As will be appreciated by one skilled in the art after reviewing the present disclosure, in some embodiments, the spring loaded reel 24 can be configured so that a spring force urges the spring loaded reel to retract the suspension member 20. However, pulling the ball 22 away from the reel housing 16 will cause the spring loaded reel 24 to rotate and unwind or un-spool a length of the suspension member 20 while moving the ball 22 away from the reel housing 16, and releasing tension or force on the ball 22, allows the spring loaded reel 24 to retract a length of the suspension member 20. These movements of the suspension member 20 are represented generally by arrow "B" in FIGS. 2 & 4. Also, a spring strength of the spring loaded reel 24 can be selected such that the spring loaded reel 24 can retract the suspension member 20 against the weight of an attached ball 22. In other embodiments, the spring strength of the spring loaded reel 24 is adjustable to accommodate a user, or pre-selected to accommodate a particular spring resistance required to facilitate a training goal of the user or users.

In addition, as shown in FIGS. 1-5, a stop 18, such as a rubber stop, can also be attached to the suspension member 20 at a point along the length of the suspension member 20 between the reel housing 16 and the ball 22. The location of the stop 18 can either be permanently set or allow adjustment of the retractable length of suspension member 20. For example, the stop 18 may be a plug type stop of any size and shape that cannot pass through the housing aperture 30, thereby stopping the retraction of the suspension member 20 at the location of the stop 18. In some embodiments of the present invention, the stop 18 is adjustable and may be attached to the suspension member 20 at any point along the length thereof. The stop 18 may be adjustable by various well known mechanical devices used to create friction between a body and a cable, as will be appreciated by one skilled in the art. For example, various types of clamps may be coupled to the stop 18, such as a threaded screw type clamp 42, illustrated in FIG. 8*c*, having an adjustable threaded shaft 44 being insertable within a mating channel 46 of the stop 18. The threaded shaft 44 may then be turned and screwed inward in the mating channel 46 to tighten a gripping end 48 of the threaded shaft 44 against the suspension member 20, thereby holding the stop 18 in place along the suspension member. The gripping end 48 may be configured to have gripping edges or protruding teeth to assist in creating friction against the suspension member 20. In other embodiments the stop 18 may be fixedly attached at a single location on the suspension member, or may be omitted altogether.

Figure 7:
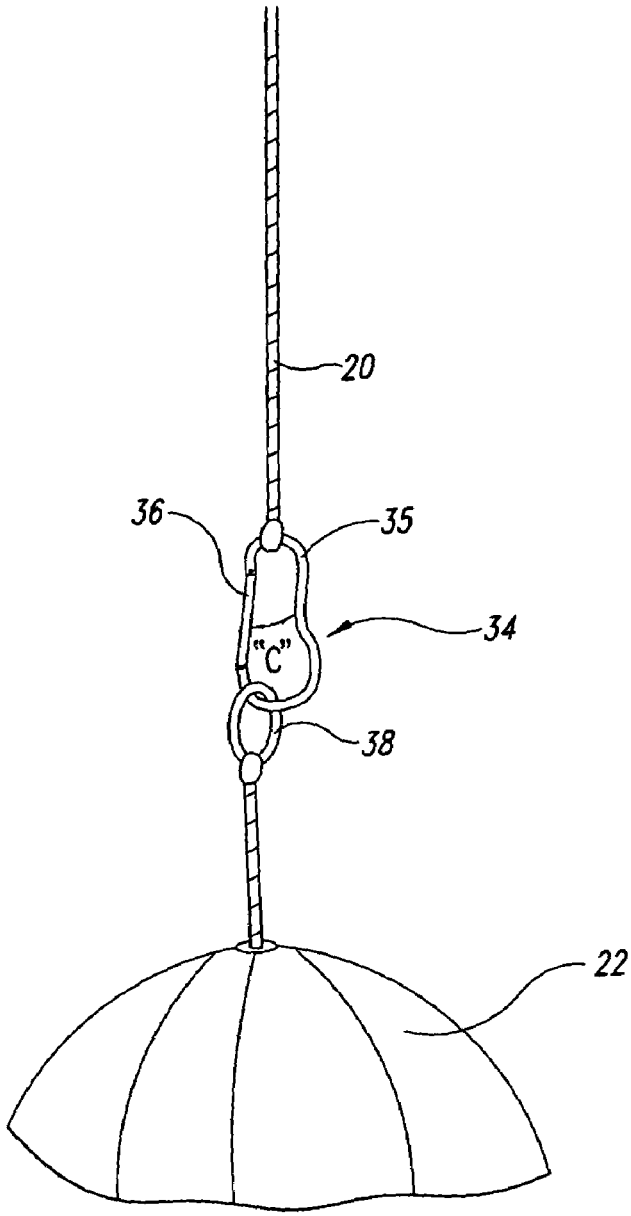
FIG. 7 is a partial perspective view of an embodiment of the present invention, showing only a cable portion with a releasable clip and a ball attached to the cable portion using the releasable clip.

In further embodiments of the present invention, a releasable clip assembly 34 is provided that allows a user to attach different balls 22 or other devices or apparatus to the suspension member 20, as shown in FIG. 7. The releasable clip assembly 34 can have a primary clip 35 with a pivotable bar 36 that is pivotable in the directions indicated by arrow "C" in FIG. 7. Also, a second clip portion 38 can be coupled to a ball 22 so that the ball 22 can be clipped onto the suspension member 20 by interlocking the primary clip 35 and second clip portion 38. The ball 22 can therefore be released from the suspension member 20 by unclipping the clip assembly 34. In this manner, the ball 22 can be easily interchanged with another ball of similar or different type, that is also attached to a second clip portion 38, or other type of clip portion that is interlockable with the primary clip 35, as will be appreciated by one skilled in the art after reviewing this disclosure.

Figure 6:
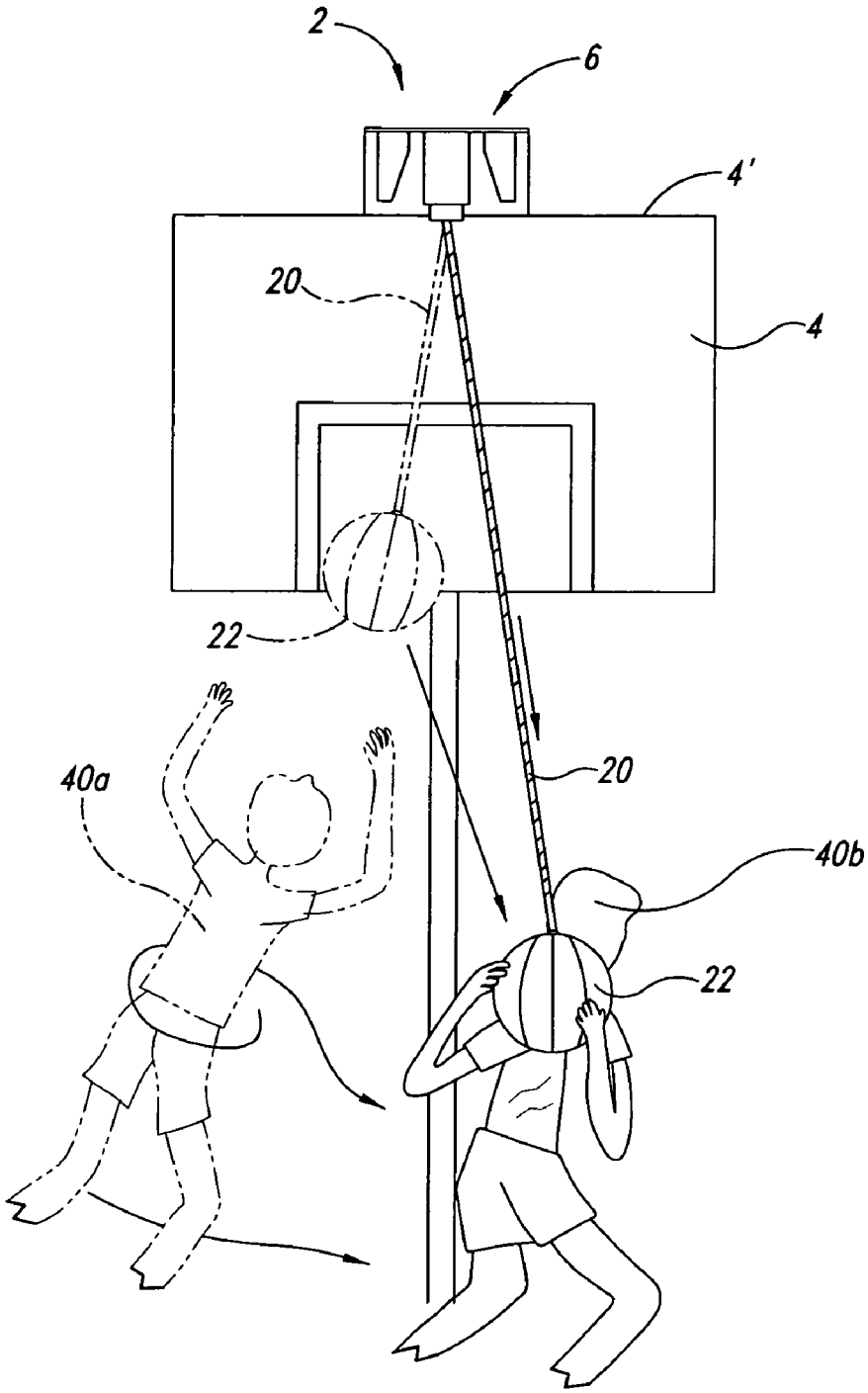
FIG. 6 is a front view of an embodiment of the training assembly of the present invention with a simplified drawing of an athlete using the training assembly wherein the athlete has jumped to grab a ball of the assembly and turned to pull the ball away, thereby simulating an aspect of rebounding during a basketball game.

Various practice methods can be employed with the present invention, including the retracting system, which, in some embodiments, comprises the reel housing 16 and its contents as well as the stop 18. As shown in FIG. 6, a player or athlete can jump in position 40*a* to grab the ball 22, and then pull the ball down to position 40*b*. FIG. 6 is only one representation of a myriad of physical maneuvers that can be practiced with various embodiments of the present invention. However, FIG. 6 is intended to illustrate generally how the training assembly 2 may be utilized in some embodiments, but is not intended to be restrictive in any way. For example, a basketball player may use the training assembly to practice such skills as rebounding. The actual height at which the ball 22 hangs can be adjusted to approximate a maximum height limit for a particular basketball player to reach when jumping—e.g. for practicing to increase the "vertical" of the player. The height of the ball can be adjusted in some embodiments of the present invention by adjusting the location of the stop 18 along the length of the suspension member 20. A player may then be required during practice to jump at the ball 22 to tip or grab the ball. If a player reaches the ball 22, the player can tip it to give it motion and then continue attempting to tip the ball. Alternatively, the player can attempt to grab and pull the ball 22 downward with the player as she or he descends from a jump, thereby simulating grabbing a ball rebounded from a basketball hoop or a backboard. As stated earlier, in some embodiments, tension is selectable in the spring loaded reel 24 to adjust the pulling and grabbing force required of a player to grab the ball 22 and pull it. In other embodiments, the tension of the spring loaded reel 24 can be changed by changing out the spring loaded reel 24 with a different spring loaded reel manufactured with a different tension. Still in further embodiments, different training assemblies 2 are equipped with different spring tensions in the spring-loaded reel 24.

Figure 11:
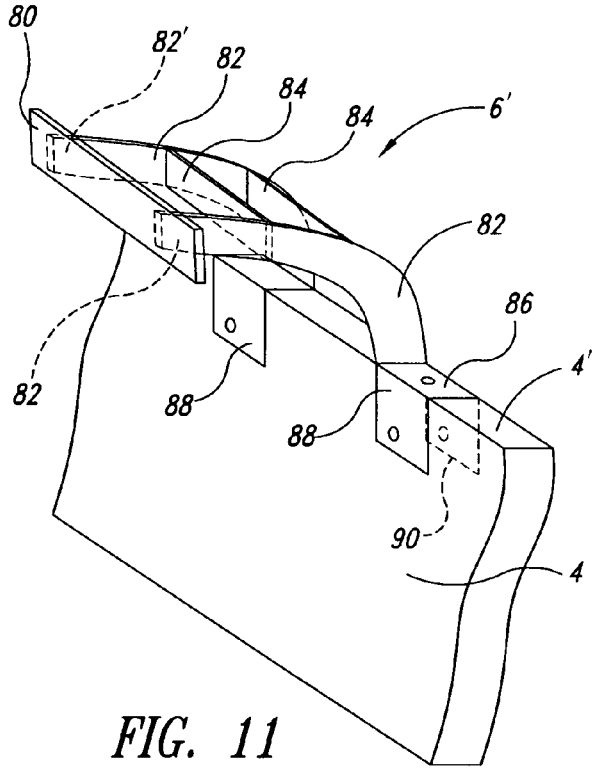
FIG. 11 is a perspective view of an alternate embodiment for some mounting brackets of the present invention, to which the reel housing of FIG. 1 can be attached.
Figure 12:
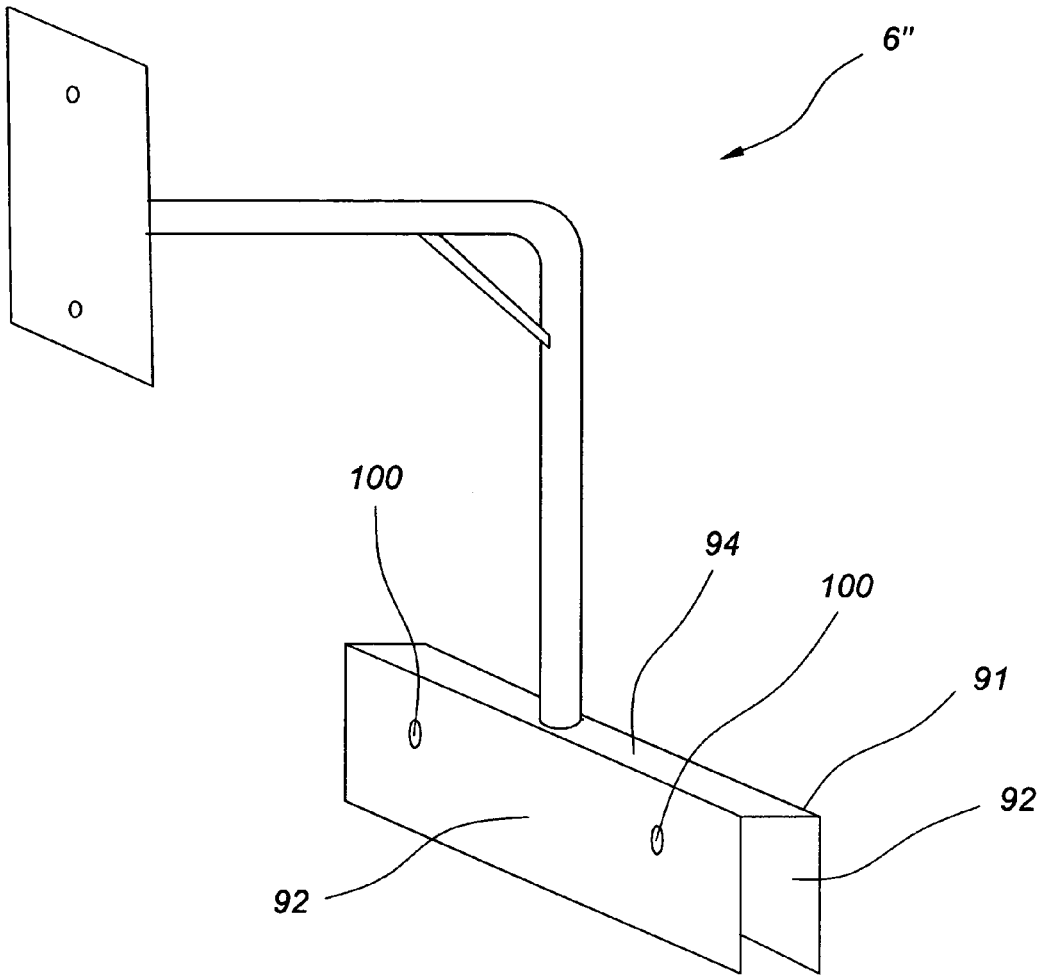
FIG. 12 is a perspective view of another alternate embodiment for some mounting brackets of the present invention, to which the reel housing of FIG. 1 can be attached.
Figure 13:
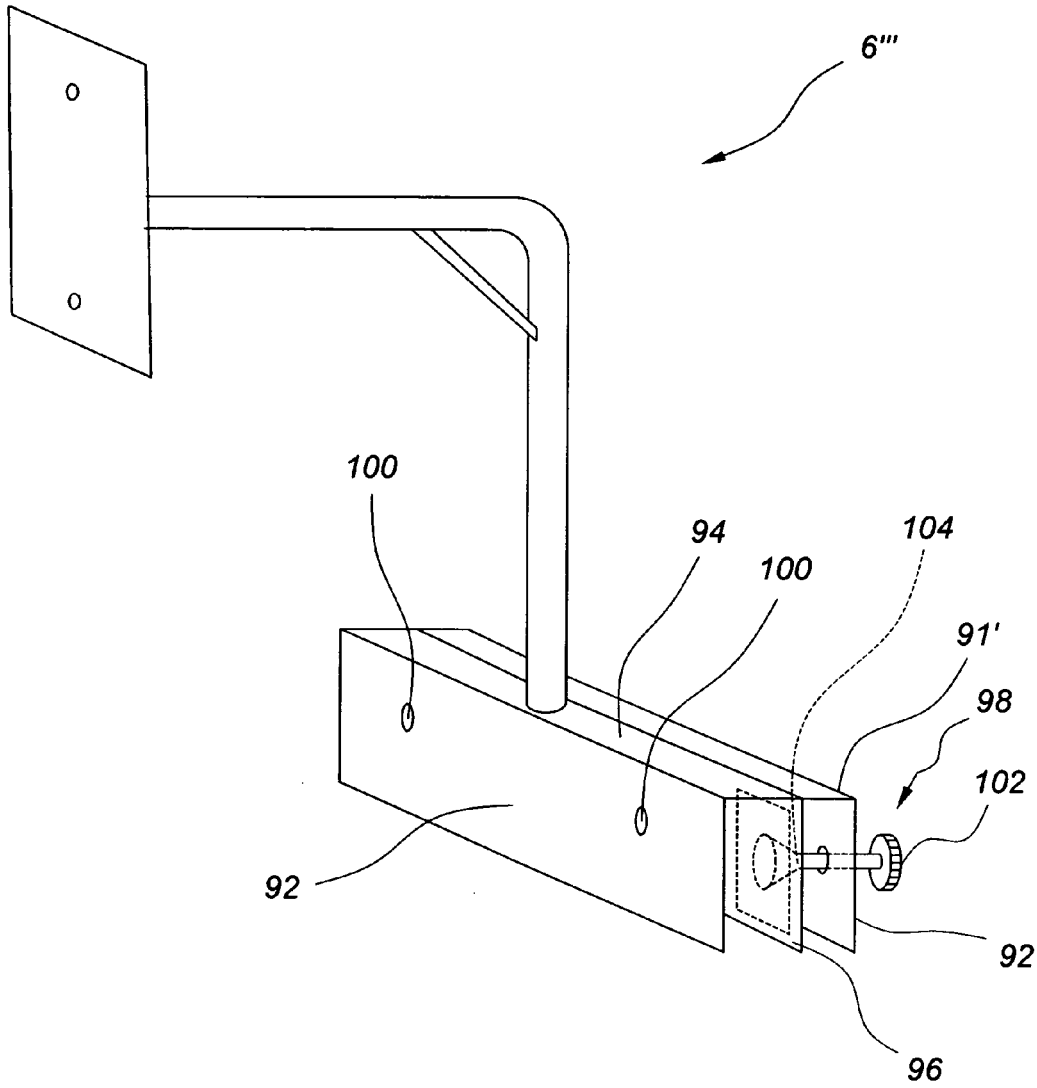
FIG. 13 is a perspective view of a further alternate embodiment for a mounting bracket of the present invention, wherein a clamp of the mounting bracket is selectively adjustable for coupling the mounting bracket to a backboard or other surface.

Various other mounting brackets can be employed in some embodiments of the present invention. For example, as shown in FIG. 11, some embodiments of the mounting bracket 6' can employ parallel retainers 82, with a reel housing coupling surface 80 to which the reel housing 16 can be attached. The parallel retainers 82 can have cross members 84 disposed between them for support. As best seen in FIGS. 12 & 13, other embodiments of the mounting bracket 6", 6''' can comprise a mounting piece 91, 91' having parallel walls 92 which can be placed around the top of a backboard 4 so that the backboard is disposed between the parallel walls 92, with a horizontal wall 94 of the mounting bracket 6", 6''' resting on the top of the backboard 4'. In some embodiments, such as illustrated in FIG. 13, an adjustable clamp comprising a movable surface 96 and one or more adjustment members 98 are provided to allow a user to tighten the movable surface 96 against a surface of the backboard 4, so as to clamp the mounting bracket 6''' on the backboard 4. The adjustment members 98 can include a knob 102 and a threaded shaft 104, with the knob 102 being usable to turn the threaded shaft 104 to screw the movable surface 96 toward a wall of the backboard 4. In addition, apertures 100 can be provided on one or more of the parallel walls 92 to allow the mounting brackets 6", 6''' to be bolted to a backboard 4. The movable surface 96 can also be adjusted to allow the mounting bracket 6''' to be adaptable to backboards 4 of different thickness.

Figure 9:
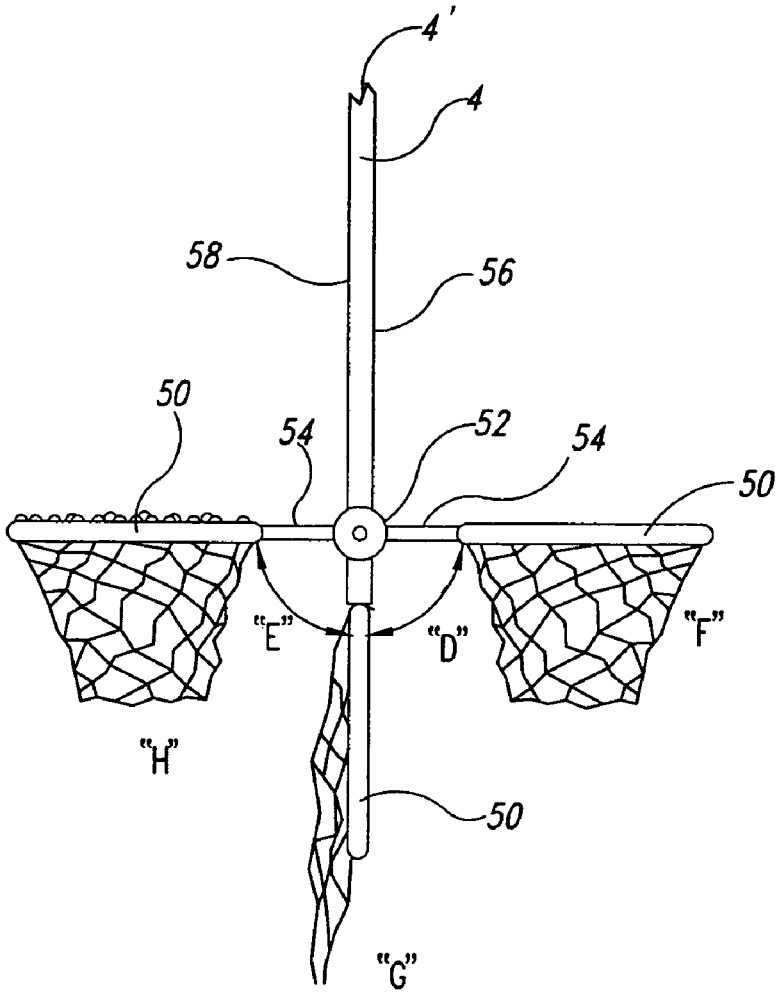
FIG. 9 is a side elevation view of a backboard of an embodiment of the present invention, wherein a basketball hoop is pivotable between positions "F," "G," or "H" to allow the basketball hoop to be moved away from a front of the backboard during training with the training assembly of FIG. 1.
Figure 10:
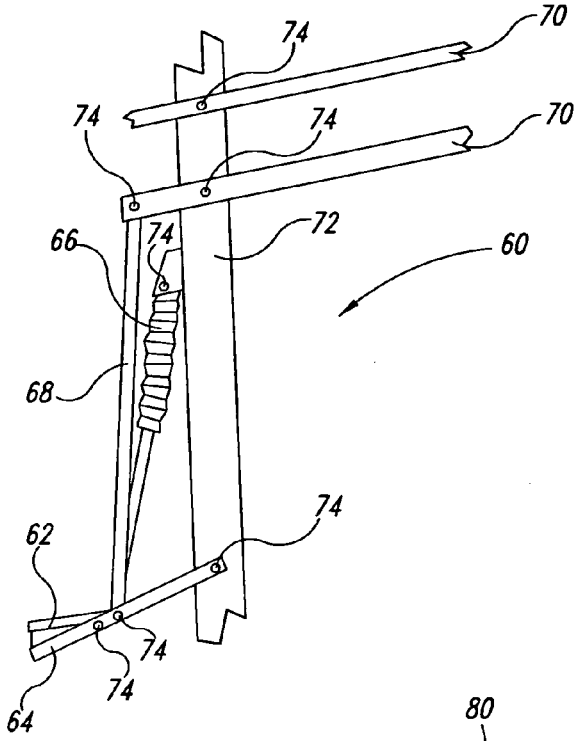
FIG. 10 (Prior Art)
FIG. 10 is a prior art side elevation view of an adjustment assembly for adjusting a height of some backboards used with various embodiments of the present invention.
Figure 14:
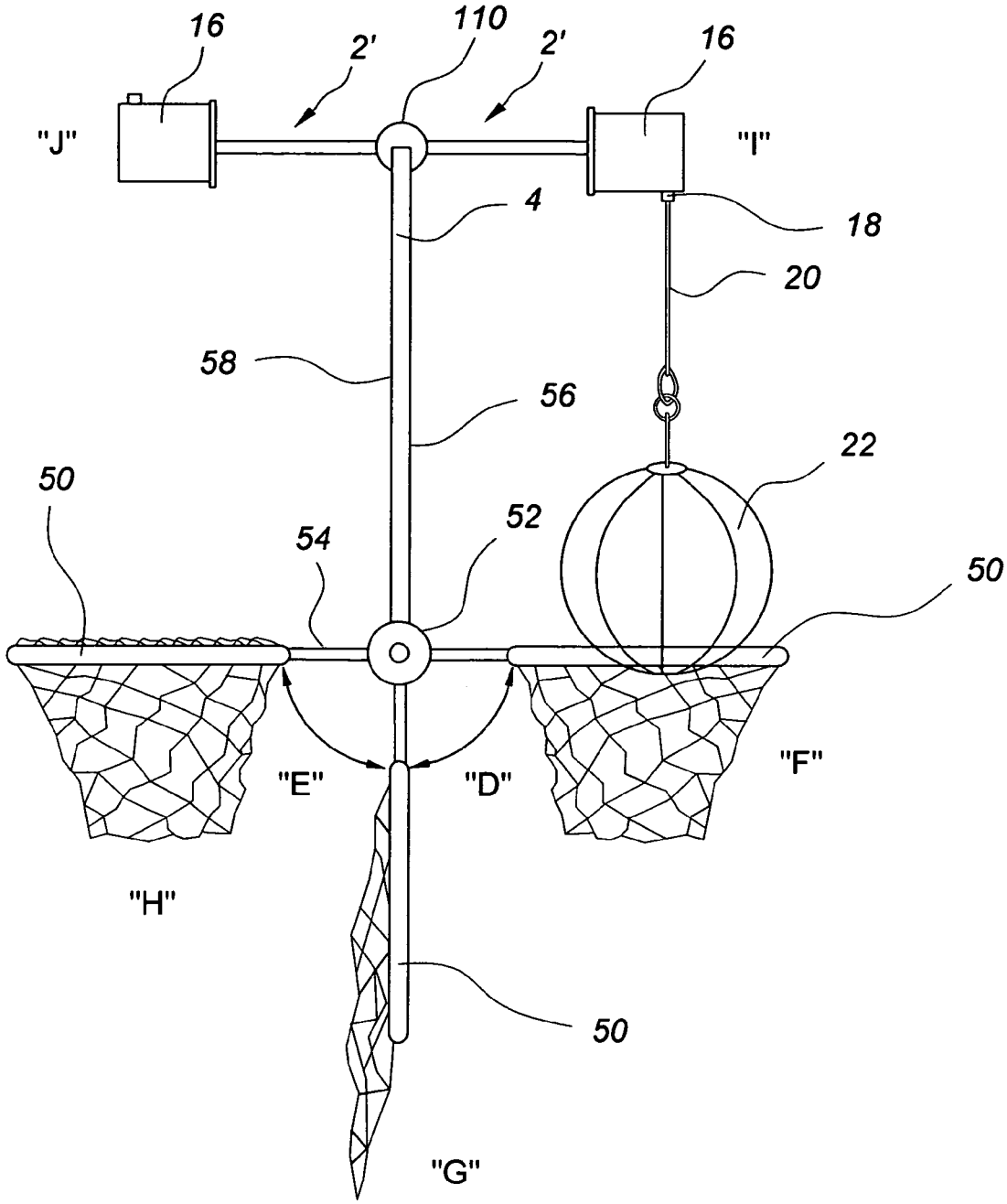
FIG. 14 is a side elevation view of an alternate embodiment of the present invention wherein the training assembly is pivotably attached to a basketball backboard to allow the training assembly to be rotated away from a front of the backboard.

Further embodiments of the present invention include a backboard 4 being adapted to have a training assembly 2' that is pivotably attached to the backboard 4, as best seen in FIG. 14. A pivotable connection 110 between the training assembly 2' and the backboard 4 can allow a user to pivot the training assembly from a position "I" in front of the backboard 4, to a position "J," away from the front of the backboard 4. Positions "I" and "J" illustrate some example positions to which the training assembly 2' can be pivoted but are not intended to be restrictive, as will be appreciated by one skilled in the art after reviewing this disclosure. Also, in other embodiments of the present invention, a basketball hoop 50 can be pivotably attached to a backboard 4 via a pivotable connection 52, as best seen in FIG. 9, to allow a user to be able to pivot the basketball hoop 50 away from a front of the backboard 4. Positions "F", "G" and "H" of the basketball hoop 50 illustrate some example positions to which the basketball hoop 50 can be pivoted in some embodiments of the present invention. Those illustrated positions are also not meant to be restrictive, as will be appreciated by those skilled in the art after reviewing this disclosure.

Figure 15:
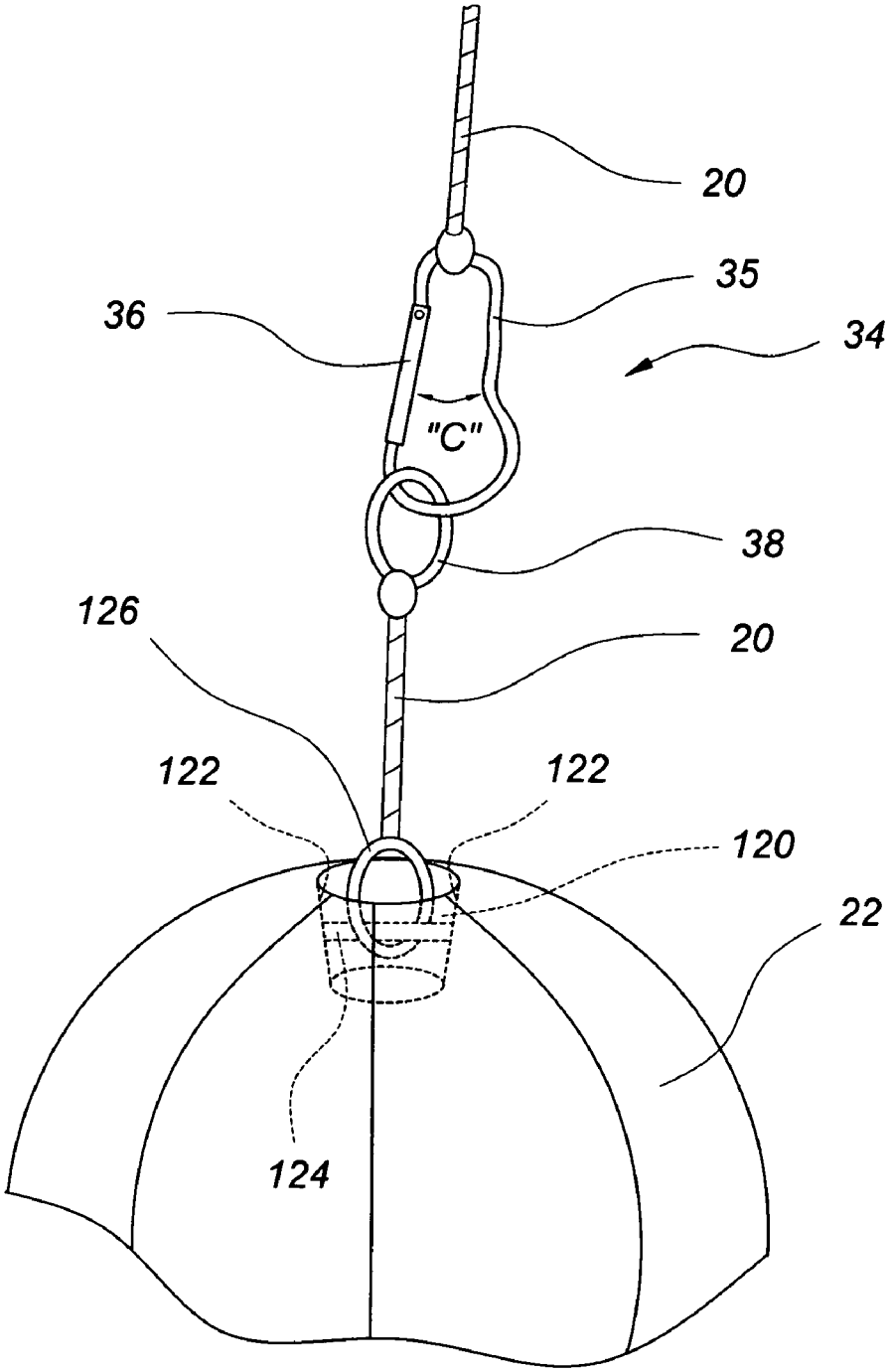
FIG. 15 is a partial perspective view of an embodiment of a ball for the present invention having a recess and a retaining bar to which the suspension member can be attached.

The present invention can also comprise one or more balls 22, such as basketballs, that are uniquely adapted for use with various embodiments of the present invention. For example, as illustrated in FIG. 15, some embodiments of the ball 22 can have a recess 120, with inner walls 122. A retainer bar 124 can extend between the inner walls 122 to which an annular or other retaining member 126 can be attached. The suspension member 20, or a portion thereof, can be attached to the retaining member 126 to couple the suspension member 20, to the ball. As disclosed supra, a releasable clip assembly 34 can be employed with the suspension member 20, as best seen in FIG. 15. In some alternative embodiments, the second clip portion 38 of the releasable clip assembly 24, can be coupled directly to the retainer bar 124.

Figure 16:
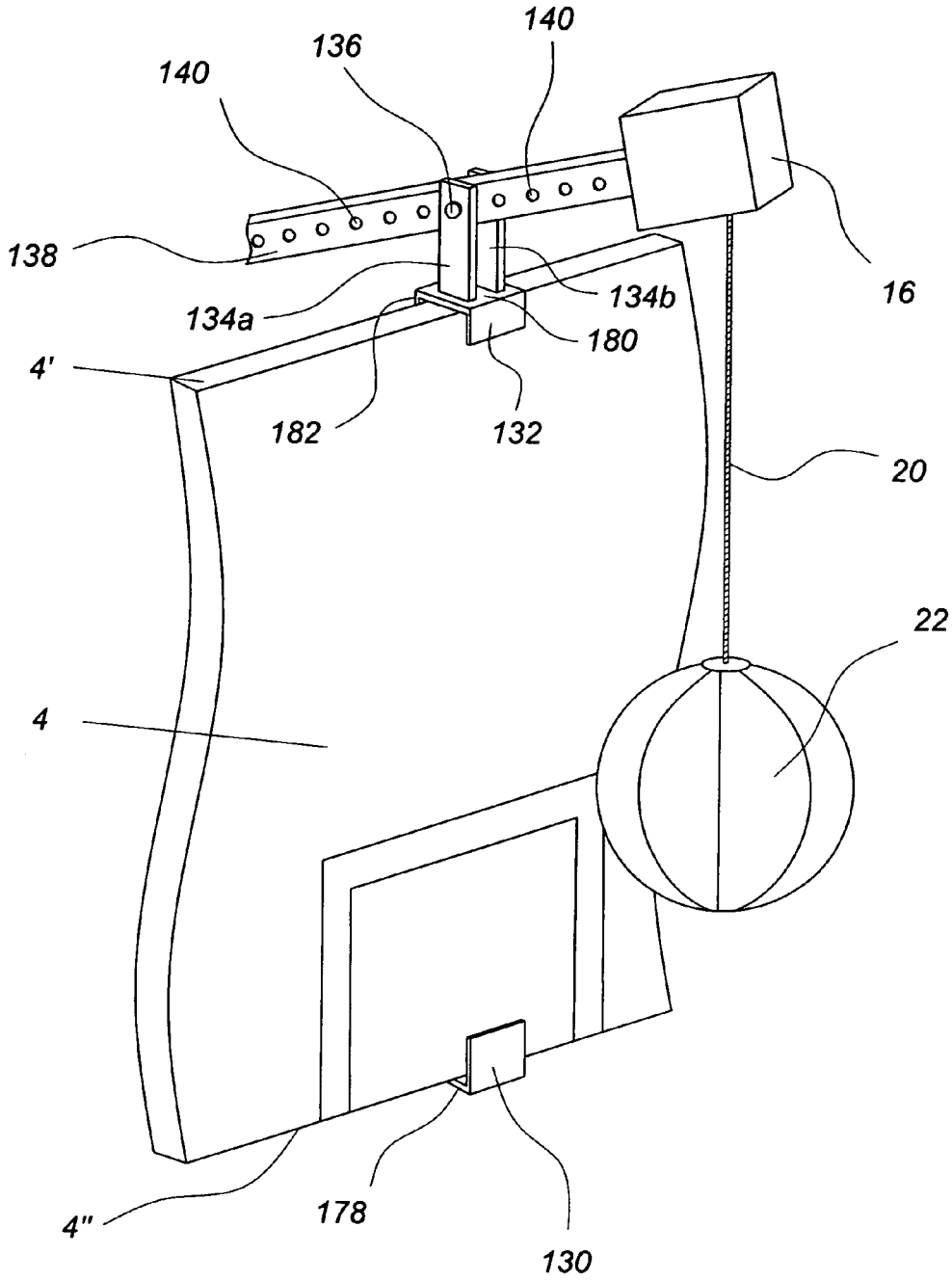
FIG. 16 is a partial perspective view of an embodiment of the present invention employing a pivotable arm for adjusting height of the ball.
Figure 17:
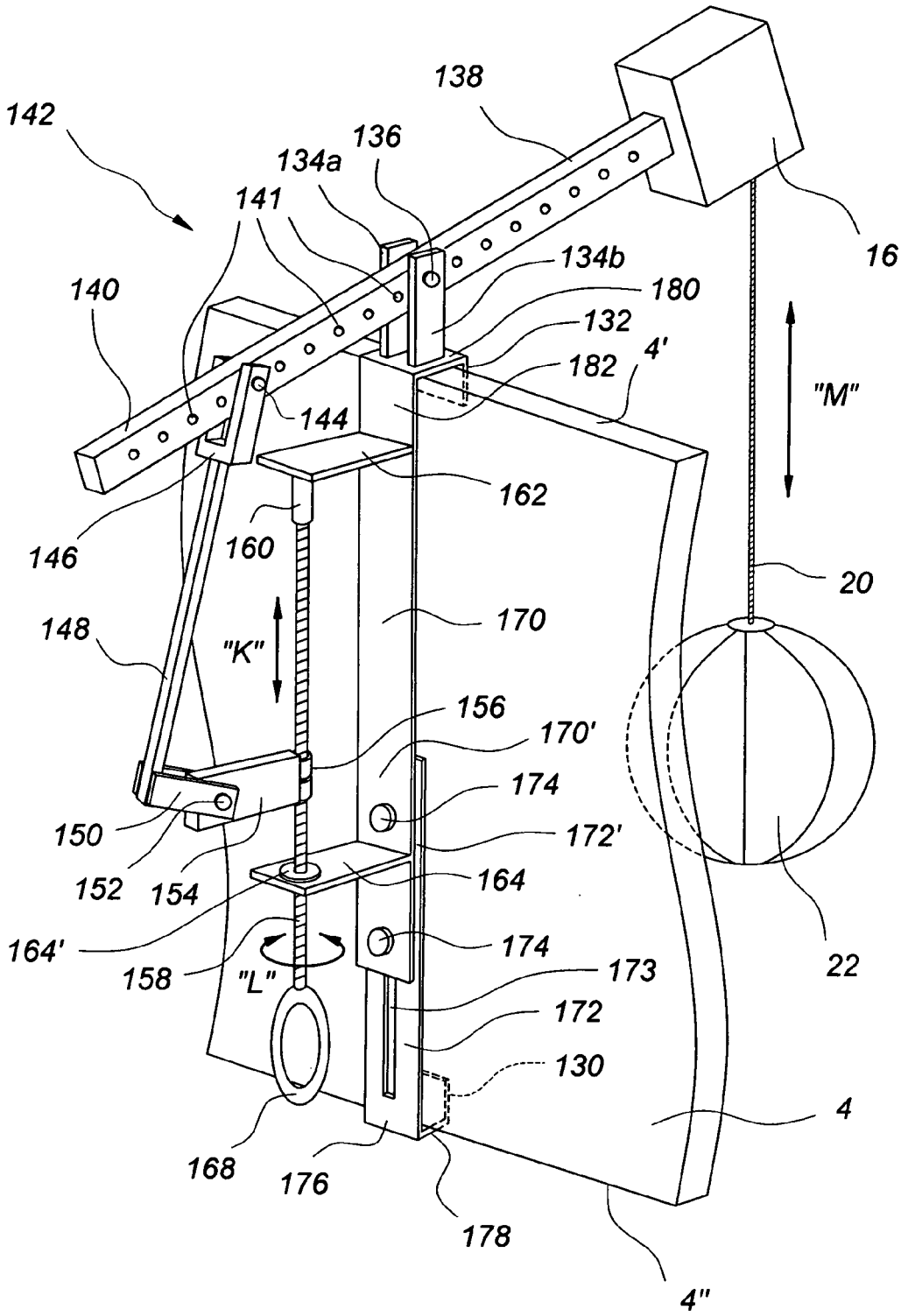
FIG. 17 is a perspective view of rear portion of the embodiment of the present invention shown in FIG. 16.

As can be seen in FIGS. 16 & 17, in another embodiment of the present invention the reel housing 16 is mounted on a height adjustment assembly 142, which includes a pivotable arm 138 that is pivotably connected to a first linking member 148. The pivotable arm 138 is also pivotably connected to stationary support members 134*a* & 134*b*. The first linking member 148 is pivotably connected to second linking member 150, which is, in turn, connected to translation member 154. A threaded drive shaft 158 is threadably coupled to the translation member 154. An upper end portion of the threaded drive shaft 158 is rotatably retained within a tubular stub 160. Also, a lower portion of the threaded drive shaft is rotatably retained within a stabilizer plate 164. The threaded drive shaft 158 can be supported by the stabilizer plate 164 using an annual member 164' welded to the threaded drive shaft 158. As will be appreciated by those skilled in the art after reviewing this disclosure, weight from the threaded drive shaft 158 can be transferred to the stabilizer plate 164 using the annular member 164', while the upper end portion of the threaded drive shaft 158 rotatably resides within the tubular stub 160.

Figure 18B:
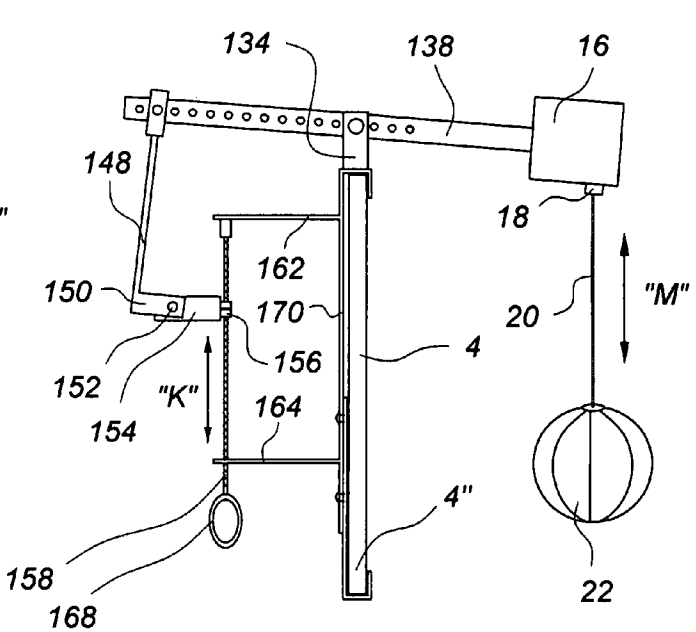
FIGS. 18A and 18B are side elevation views of the embodiment of the present invention shown in FIG. 17, with the pivotable arm being in a first position in FIG. 18A and a second position in FIG. 18B. FIG.
Figure 18A:
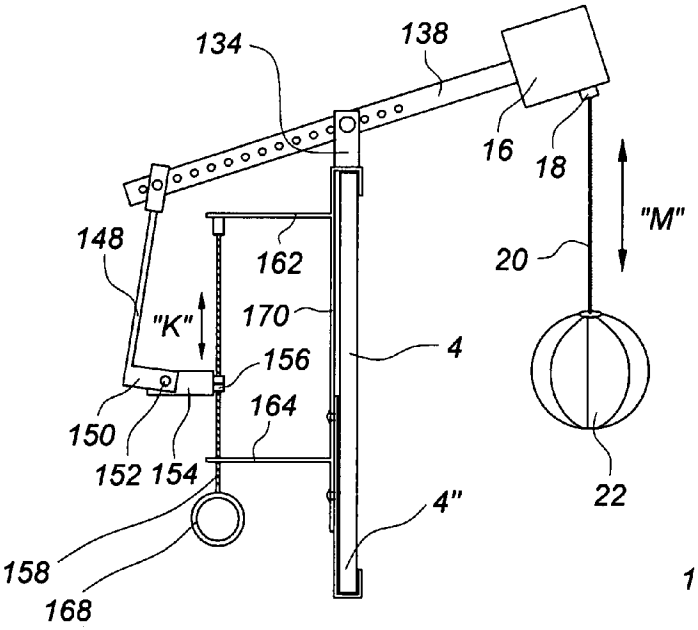
Figure 18C:
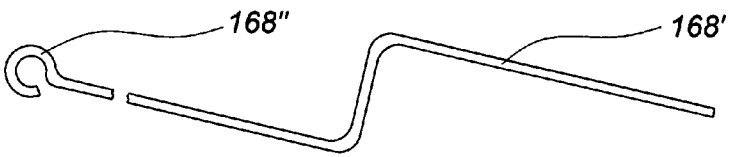
FIG. 18C is an example embodiment of an extension crank useable with some embodiments of the present invention for adjusting a height of the reel housing.

The threaded drive shaft 158 can be turned in the directions of arrow "L" to drive a rearward section 140 of the pivotable arm 138 upward or downward, depending on the direction in which the threaded drive shaft 158 is turned. This can cause the reel housing 16, and hence the ball 22, to be raised or lowered, as is selectable by a user. As exemplified in FIGS. 18A & 18B, as the threaded drive shaft 158 is turned, the ball 22 can be lowered from a first position (See, FIG. 18A) to a second position (See, FIG. 18B). Conversely, reversing the direction of rotation of the threaded drive shaft 158, can cause the ball 22 to be raised. An extension crank 168' can be provided that can be removably coupled to the threaded drive shaft 158. In some embodiments, the extension crank 168' has an end portion 168" with a curvature configured to be insertable within an annular coupling 168 of the threaded drive shaft 158 to grip the annular coupling 168 and to allow a user to turn it in the directions of arrow "L" using the extension crank. A cover or cover assembly (not shown) can be provided to fit over a portion of the height adjustment assembly 142.

As best seen in FIG. 17, the height adjustment assembly 142 can also comprise an adjustable mounting clamp having an upper clamp section 170 and a lower clamp section 172. The upper clamp section 170 can have an upper clamp grip 132, and lower clamp section 172 can have a lower clamp grip 130. Each of the upper and lower clamp grips 130, 132 can be configured to fit over top and bottom edges, respectively, of a backboard 4.

The upper and lower clamp sections 170, 172 can each be elongated such that a lower portion 170' of the upper clamp section 170 can overlap an upper portion 172' of the lower clamp section 172. In some embodiments, the lower clamp section 172 includes an elongated slot 173. The upper clamp section 170 can have apertures through which connection members 174, such as threaded bolts or nuts, can be inserted and extended through the elongated slot 173 of the lower clamp section 172, to secure the upper and lower clamp sections 170, 172 together. As will be appreciated by those skilled in the art after reviewing this disclosure, a wide variety of connection members 174 can be utilized to secure the upper and lower clamp sections together, such as threaded nuts or screws combined with mating nuts (not shown) to tighten and secure the threaded nuts or screws. The adjustable mounting clamp can thus be adjusted to fit various backboards 4 having different vertical dimensions.

Although specific embodiments and examples of the invention have been described supra for illustrative purposes, various equivalent modifications can be made without departing from the spirit and scope of the invention, as will be recognized by those skilled in the relevant art after reviewing the present disclosure. The various embodiments described can be combined to provide further embodiments. The described devices and methods can omit some elements or acts, can add other elements or acts, or can combine the elements or execute the acts in a different order than that illustrated, to achieve various advantages of the invention. These and other changes can be made to the invention in light of the above detailed description.

In general, in the following claims, the terms used should not be construed to limit the invention to the specific embodiments disclosed in the specification. Accordingly, the invention is not limited by the disclosure, but instead its scope is determined entirely by the following claims.

What is claimed is:

1. An athletic training assembly coupled to a basketball backboard, the training assembly comprising:

a mounting member and reel attached to the mounting member;

a suspension member attached to the reel, the reel being configured to apply tension on the suspension member except that an opposing force applied by a user of the training assembly can be sufficient to overcome a tension applied by the reel;

a ball attachable to the suspension member; and a height adjustment assembly configured to permit a user to select a height of the reel independent of the height of the basketball backboard, by controlling an adjustment member that is located remote from the reel.

2. The athletic training assembly of claim 1 wherein the mounting member is pivotably attached to the basketball backboard.

3. The athletic training assembly of claim 1 further comprising a threaded drive shaft which can be rotated to adjust a height of the reel.

4. The athletic training assembly of claim 1 further comprising a pivotable arm coupled to at least one of the reel and a housing containing the reel, the pivotable arm being pivotable in relation to the backboard to raise and lower the reel.

5. The training assembly of claim 1 wherein the height adjustment assembly has an adjustable mounting clamp capable of being adjusted to clamp the height adjustment assembly to different backboards having different dimensions.

6. The athletic training assembly of claim 1 further comprising a stop coupled to the suspension member.

7. The athletic training assembly of claim 1 wherein the ball is interchangeable with a different ball by being releasably coupled to the suspension member.

8. The athletic training assembly of claim 1, further comprising a basketball hoop that is pivotably attached to the basketball backboard, the basketball hoop being movable without being detached from the basketball backboard to move the basketball hoop to an orientation that is at least one of aligned with a face of the basketball backboard and extending rearward away from the basketball backboard.

9. An athletic training assembly comprising:

a basketball hoop pivotably attached to a basketball backboard and selectively positionable in an orientation that is at least one of downward below a face of the basketball backboard and rearward extending away from the basketball backboard;

a spring loaded reel disposed near a face of the basketball backboard;

a reel housing mounted on a pivotable member for holding the spring loaded reel;

a suspension member attached to the spring-loaded reel at a first end portion of the suspension member; and a ball coupled to the suspension member.

10. The athletic training assembly of claim 9 wherein the ball has a recess with a retainer bar extending between inner walls of the recess, and wherein the ball can be removably coupled to the suspension member.

11. The athletic training assembly of claim 9 further comprising an adjustable stop attached to the suspension member for stopping the suspension member from being retracted past a particular location by the spring loaded reel.

12. The athletic training assembly of claim 10 wherein the mounting clamp comprises an upper clamp section and a lower clamp section, with the upper clamp section being movable relative to the lower clamp section for adjusting the mounting clamp.

13. The athletic training assembly of claim 12 wherein at least one of the upper clamp section and lower clamp section has an elongated slot.

14. The athletic training assembly of claim 9 wherein the reel housing is attached to a pivotable arm.

15. The athletic training assembly of claim 9 wherein the reel housing is supported by a pivotable member with the pivotable member being linked to a drive shaft for adjusting a height of the reel housing.

16. A method of training an athlete comprising:

providing a spring loaded reel with a suspension member attached to the spring loaded reel, and with a ball attached to the suspension member;

hanging the ball proximate a front surface of a basketball backboard using the suspension member;

retracting the suspension member to pull the ball upward using the suspension member; and adjusting a height of the spring loaded reel independently from the height of the basketball backboard by manually adjusting an adjustment member, the adjustment member being disposed below the basketball backboard.

17. The method of claim 16 wherein retracting the suspension member to pull the ball upward comprises providing a spring loaded reel attached to the suspension member, said spring loaded reel being capable of retracting the suspension member against a weight of the ball.

18. The method of claim 17 further comprising stopping the suspension member from being retracted past a particular point by providing a stop on the suspension member such that if the suspension member is retracted a certain distance by the spring loaded reel, the stop is pulled up against a surface, whereby the suspension member is prevented from being retracted further.

19. The method of claim 16 wherein retracting the ball is accomplished by providing a reel configured to apply tension on the suspension member.

20. The method of claim 19 further comprising adjusting a tension on the suspension member.

21. The method of claim 20 further comprising changing out the reel to change tension on the suspension member.

22. The method of claim 16 wherein the suspension member is coupled to a reel and further comprising adjusting a height at which the ball hangs by adjusting a height of the reel.

23. The method of claim 22 wherein adjusting the height at which the ball hangs further comprises rotating a threaded shaft.

* * * * *